US008732991B2

(12) United States Patent
Claessens et al.

(10) Patent No.: US 8,732,991 B2
(45) Date of Patent: May 27, 2014

(54) CUTTER HEAD FOR DREDGING GROUND AND USE OF THIS CUTTER HEAD FOR DREDGING GROUND

(75) Inventors: Stijn Claessens, Meerbeek (BE); Klaas Geert Wijma, Haarlem (NL)

(73) Assignees: Dredging International N. V., Zwijndrecht (BE); Vosta LMG B.V., Amsterdam (NL)

( * ) Notice: Subject to any disclaimer, the term of this patent is extended or adjusted under 35 U.S.C. 154(b) by 401 days.

(21) Appl. No.: 13/143,048

(22) PCT Filed: Dec. 29, 2009

(86) PCT No.: PCT/EP2009/068002
§ 371 (c)(1), (2), (4) Date: Sep. 21, 2011

(87) PCT Pub. No.: WO2010/079108
PCT Pub. Date: Jul. 15, 2010

(65) Prior Publication Data
US 2012/0000712 A1 Jan. 5, 2012

(30) Foreign Application Priority Data
Jan. 9, 2009 (BE) ..... 2009/0010

(51) Int. Cl.
*E02F 3/88* (2006.01)

(52) U.S. Cl.
USPC ..... 37/327

(58) Field of Classification Search
USPC ..... 37/317–324, 327–333, 342, 455, 326; 299/87.1, 75, 85.2, 77, 79.1, 102
See application file for complete search history.

(56) References Cited

U.S. PATENT DOCUMENTS

| | | | | |
|---|---|---|---|---|
| 4,320,925 | A | 3/1982 | Bowes, Jr. | |
| 4,986,011 | A | 1/1991 | van Hemmen et al. | |
| 5,967,246 | A | 10/1999 | Caraway et al. | |
| 7,647,712 | B2 * | 1/2010 | Tack | 37/328 |
| 7,739,812 | B2 * | 6/2010 | Wijma | 37/337 |
| 7,971,375 | B2 * | 7/2011 | Gabela et al. | 37/455 |
| 2007/0245602 | A1 * | 10/2007 | Gabela et al. | 37/454 |

FOREIGN PATENT DOCUMENTS

| | | |
|---|---|---|
| JP | H01098261 | 6/1989 |
| NL | 7708755 | 2/1979 |
| NL | 178992 | 1/1986 |
| WO | 2005005737 | 1/2005 |

* cited by examiner

*Primary Examiner* — Robert Pezzuto
(74) *Attorney, Agent, or Firm* — Bret E. Field; Bozicevic, Field & Francis, LLP

(57) ABSTRACT

The invention relates to a cutter head (10) for dredging ground under water, this cutter head being suitable for attachment rotatably around a central axis to the ladder (2) of a cutter suction dredger (1) and for being moved through the ground (9) therewith in a lateral sweeping movement, the cutter head comprising a base ring (13), a hub (14) situated at a distance in the direction of the central axis from the base ring, and a plurality of arms (15) extending from the base ring to the hub, wherein a passage opening (16) is located between arms and wherein the arms are provided with a first series of cutting tools on a leading part (15*a*) relative to the direction of rotation of the cutter head, and wherein at least one arm is provided with a second series of cutting tools on a part of the arm (15*b*) facing away from the central axis.

18 Claims, 2 Drawing Sheets

CUTTER HEAD FOR DREDGING GROUND AND USE OF THIS CUTTER HEAD FOR DREDGING GROUND

The invention relates to a cutter head for dredging ground under water, this cutter head being suitable for attachment to the ladder of a cutter suction dredger and for being moved over the ground therewith in a lateral sweeping movement. The invention also relates to the use of this cutter head for dredging ground, and in particular relatively hard ground.

A cutter head of the type described in the preamble is known for instance from NL 1031253. The known cutter head is a revolving body rotatable around a central axis and formed by a base ring and a hub which is placed at a distance therefrom and concentrically thereto and between which extend a number of arms provided with cutting tools such as teeth. Situated between the arms are passage openings along which the dredged ground can be discharged. For a good cutting action the cutting tools must be first to come into contact with the ground during rotation of the known cutter head. The cutting tools are therefore situated on a leading part of the arms as seen in the rotation direction of the cutter head.

The cutter head is applied in combination with a cutter suction dredger (also referred to as cutter dredger). A cutter suction dredger is a ship anchored in the ground by means of spud posts. This anchoring creates a means for absorbing and transmitting to the ground the reaction forces occurring during dredging. Attached to the ladder of the cutter suction dredger is a suction conduit which is connected to the cutter head and along which the dredged ground is removed. During dredging the cutter head is set into rotation and with ladder and suction conduit lowered into the water at a generally oblique angle until it touches the ground. The cutter head is subsequently dragged through the ground by hauling the ladder alternately from port side to starboard side using winches. The cutter head hereby makes a lateral sweeping movement through the ground. By causing the cutter head to rotate about the axis of the cutter head—the line connecting the centres of rotation of the base ring and the hub—the tips of the cutting tools strike the ground with great force under the weight of the cutter head, ladder and suction conduit. Via the passage openings between the arms the hereby formed fragments are suctioned up by the suction conduit and discharged. A whole ground surface can be dredged by moving the cutter suction dredger over a determined distance at a time and repeating the above stated sweeping movement.

JP 01098261 describes a cutter head comprising a base ring and a hub, between which a number of arms, provided with cutting tools such as teeth extend. The cutting tools are situated on a leading part of the arms as seen in the rotation direction of the cutter head. As shown in FIG. 4 of JP 01098261, the arms are further provided with guiding plates 12 that do not exert any cutting action but aim at urging the flow of cut bottom material towards a suction conduit.

WO 2005/005737 describes a cutter head of the known type, the cutting tools thereof being connected to the arms through holders, whereby the cutting tools are detachably arranged on the holders, in particular by having a rear leg portion that is insertable in a cavity of the holder, which cavity is designed to receive the leg portion.

NL 8104969 describes a cutter head comprising a base ring and a hub, between which a number of arms, provided with cutting tools such as teeth extend. The cutting tools are situated on a leading part of the arms as seen in the rotation direction of the cutter head. The hub is provided with a number of grooves that aid in urging the flow of cut bottom material towards a suction conduit. In order to reduce the load per cutting tool at the foremost part of the arms, this part is provided with more cutting tools than the remaining part of the arms.

U.S. Pat. No. 5,967,246 describes a rotary drill bit for use in drilling holes in subsurface formations. The rotary drill bit of U.S. Pat. No. 5,967,246 comprises a bit body having a leading face and a gauge region, the bit body being provided with a number of cutting elements, fluid channels and nozzles for supplying drilling fluid to the channels for cleaning and cooling the cutting elements. The gauge region comprises a bearing surface wherein a plurality of recesses are formed. The described drill bit reduces drilling vibrations that may cause harm to the cutting tools.

The known cutter head has the drawback that relatively hard ground, such as for instance rock, defined in the context of the present application as ground with an Unconfined Compressive Strength (UCS) of at least 50 MPa, either cannot be dredged or can only be drenched with limited efficiency. The UCS is a concept known to the skill person and represents the compressive strength of a ground mass, the side walls of which are not supported during compression. Efficiency is understood in the context of this application to mean the volume of ground dredged per unit of time and unit of power.

The present invention has for its object to provide a cutter head for a cutter suction dredger which, in addition to other advantages, can dredge ground surfaces more efficiently and which particularly makes it possible to dredge relatively hard types of ground in an efficient manner.

The cutter head according to the invention has for this purpose the feature that the arms comprise a first series of cutting tools on a leading part as seen in the direction of rotation of the cutter head, and that at least one arm comprises a second series of cutting tools on a part facing away from the central axis. Although it is unusual to provide a part of an arm facing away from the central axis with cutting tools, an improved efficiency is obtained. It has been found, surprisingly, that the connection of the cutting tools to the part of the arm facing away from the central axis is sufficiently strong to transmit to the arm the forces resulting from the cutting tools striking against particularly hard ground such as rock. More cutting tools can in this way be placed on a single arm than according to the prior art. This provides advantages, particularly in the dredging of relatively hard ground.

In a first embodiment the arms comprise edges, and the arms are provided with the first series of cutting tools on a leading edge relative to the rotation direction of the cutter head, and at least one arm is provided with the second series of cutting tools on an edge of the arm facing away from the central axis. Because the cutting tools are placed on a leading edge relative to the rotation direction of the cutter head and an edge of the arm facing away from the central axis, the cutting tools are enclosed by a larger free space. This further improves the efficiency of the cutter head.

The cutter head can comprise a variable number of arms. The cutter head particularly comprises at least six and preferably at least eight arms, wherein passage openings are located between the arms. It is unusual to place such a number of arms on a cutter head, since less space is hereby available for the passage openings located between arms. Although smaller openings could adversely affect the operation of the cutter head, it is found on the contrary that an operation is obtained which is good for processing hard ground materials. Because the invention makes it possible to place a plurality of cutting tools on a single arm, relatively smaller pieces of ground are obtained during dredging, which can be discharged efficiently through the openings in the cutter head.

The number of cutting tools per arm can be variable, the number preferably being higher the harder the ground. At least one arm particularly comprises at least eight, preferably at least ten, more preferably at least twelve, even more preferably at least fourteen, even more preferably at least sixteen, and most preferably at least eighteen cutting tools. Such a number of cutting tools is found to break up the ground for dredging into sufficiently small pieces, while the discharge of the pieces of ground material is not impeded, or hardly so, by the cutting tools. By providing the cutter head with a larger number of cutting tools than known hitherto, a favourable P/S ratio is obtained, in particular for relatively hard grounds. The P/S ratio is known to the person skilled in the art, and stands for the penetration/spacing ratio, wherein the penetration involves the depth over which the cutting tools penetrate into the ground, and the spacing involves the distance between two successively impacting cutting tools. It is advantageous here for the cutting tools to be distributed regularly along the length of the arms. The (peak) loads which occur are hereby reduced, this resulting in a smoother operation of the cutter head.

In an advantageous embodiment the cutting tools of an arm of the first series are offset relative to the cutting tools of the second series. This further increases the efficiency of the dredging process. Because the cutting tools are offset, an increased working area of the cutting tools is obtained. This is because cutting tools of the second series are not obstructed by cutting tools of the first series.

In yet another embodiment the arms have a length and the cutting tools are located on either side of the middle of the arms along a maximum of 80% of the length of the arm, preferably as measured from the base ring. The absence of cutting tools of the first and/or second series close to the outer ends of the arms (close to the hub, and preferably along at most 20% of the length of the arms, as measured from the hub) is not found to adversely affect the efficiency of the cutter head, while owing to this measure the construction of the cutter had become simpler and therefore cheaper. It has been found particularly that the absence of second cutting tools close to the hub of the cutter head is advantageous.

The cutting tools can be formed integrally with the arms of the cutter head. Another method is to connect them directly to the arms, for instance by welding cutting tools embodied substantially in steel to arms manufactured substantially from steel, this resulting in a strong connection. The cutting tools can particularly be connected to the arms via coupling means. Cutting tools can hereby be replaced easily, which may be necessary as a result of wear or damage. It is advantageous here to connect the coupling means themselves integrally with the arms, such as by making use of a welded connection.

In a preferred embodiment of the cutter head according to the invention the arms of the cutter head are provided with guides on which the coupling means and/or the cutting tools are displaceably mounted. A suitable guide comprises for instance a guide rail over which the coupling means and/or the cutting tools can slide. The present preferred variant has the advantage that the coupling means and/or the cutting tools can be displaced easily. The intermediate distance between the cutting tools can thus be adjusted in simple manner depending on the properties, and in particular the hardness, of the ground.

In another embodiment the arms are provided with plough-like guides for urging ground parts in the direction of the openings between arms. This measure is found to positively affect the discharge of ground parts through openings in the cutter head. Fewer blockages of the openings are found to occur when the ground parts are urged in the direction of the openings between arms. The plough-like guides can be embodied as upright edges on the leading part relative to the rotation direction of the cutter head and on a part of the arm facing away from the central axis. The plough-like guides can also be integrally formed with the cutting tools and/or the coupling means.

The invention also relates to the use of a cutter head according to the present invention for cutting into ground parts a ground with an Unconfined Compressive Strength of between 50-200 MPa, preferably between 60-150 MPa and most preferably 80-100 MPa. For the advantages of the use of the cutter head reference is made to the advantages already stated above of the cutter head according to the present invention.

The invention also relates to a cutter suction dredger provided with a cutter head according to the present invention. With a cutter suction dredger provided with a cutter head according to the present invention ground, and in particular relatively hard ground, i.e. a ground with a UCS of more than 50 MPa, can be dredged with an improved efficiency.

The invention will now be further elucidated on the basis of the following figures and description of preferred embodiments, without the invention otherwise being limited thereto. The figures are not necessarily drawn to scale. In the figures.

Figure 1:
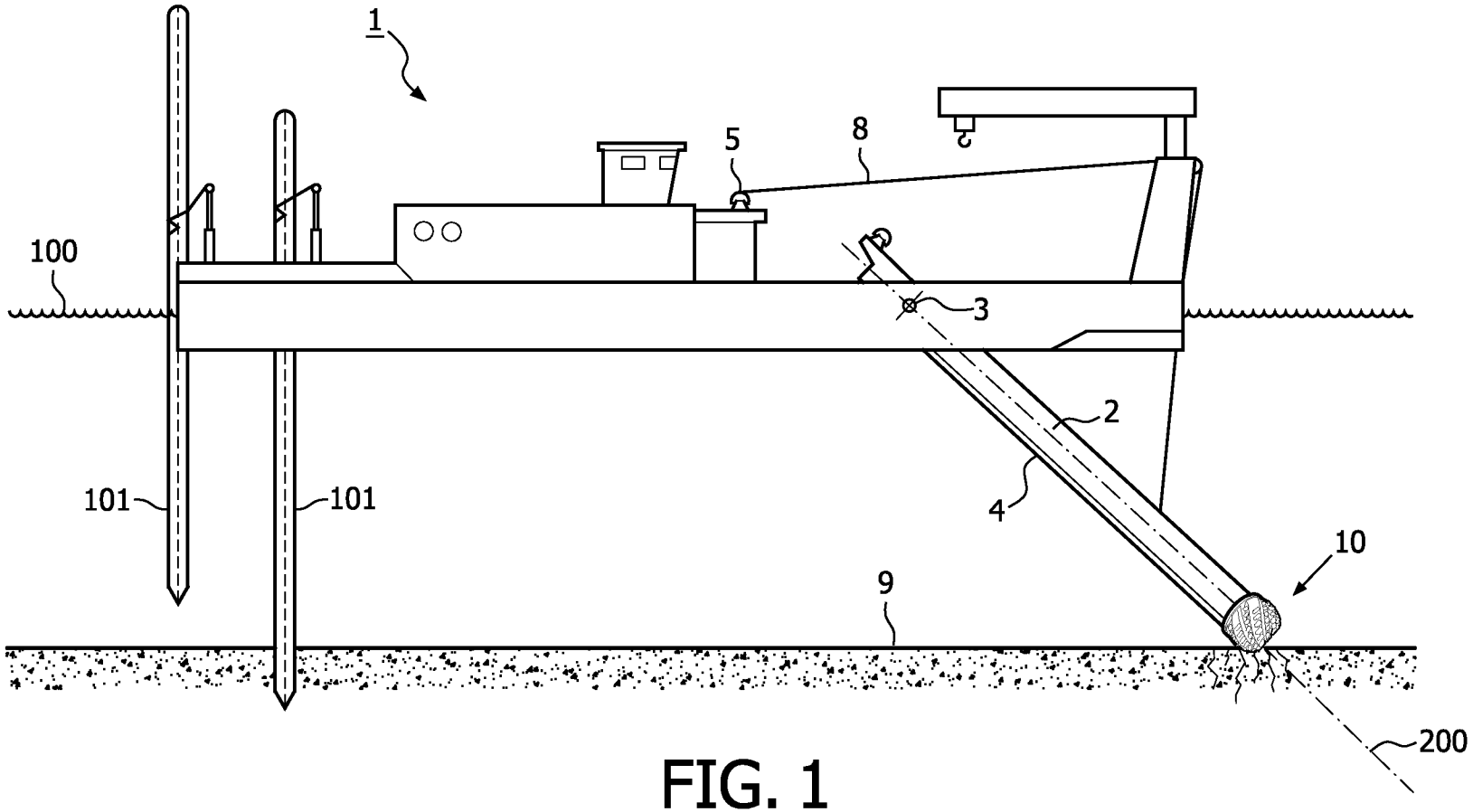
FIG. 1 shows a schematic side view of a part of a cutter suction dredger with a ladder attached thereto and provided with a cutter head according to the invention.

FIG. 1 shows a cutter suction dredger 1 on which a ladder 2 is mounted pivotally around a horizontal shaft 3. Ladder 2 is provided with a suction pipe 4 which can suction up the loosened ground parts to a level above water surface 100, after which they are discharged. Ladder 2 is hauled over the ground surface 9 for dredging or breaking by means of a winch 5 which is arranged on the deck of cutter suction dredger 1 and is provided with a number of swing winches (not shown) and ladder winch 8. Ladder 2 is provided on the outer end thereof with a cutter head 10 according to the invention. Cutter head 10 can be lowered under water by means of the ladder winch cables 8 and moved during use over ground surface 9 in a reciprocating, sweeping movement from the port side to the starboard side of cutter suction dredger 1 and back. In order to be able to absorb the forces generated here on the ground surface, cutter suction dredger 1 is anchored in the ground by means of a spud post 101. FIG. 1 shows the left-hand (starboard) spud post in unanchored position and the right-hand (port side) spud post in anchored position.

Figure 2:
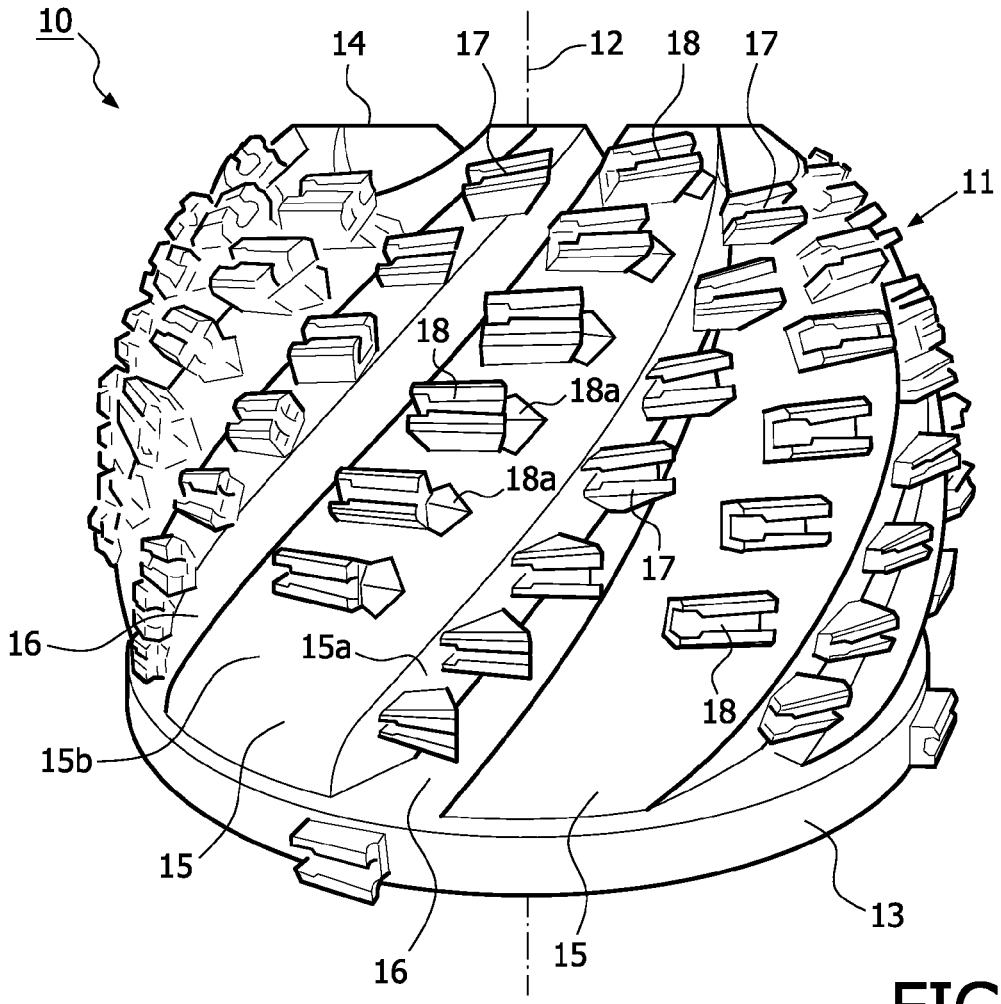
FIG. 2 shows a perspective view of a cutter head according to the invention.

Referring to FIG. 2, cutter head 10 according to the invention comprises a revolving body 11 which can be set into rotation around its rotation axis 12 by means of drive means (not shown). Rotation axis 12 herein coincides with the central axis of cutter head 10. In the shown embodiment revolving body 11 is set into rotation in clockwise direction R as seen from the bridge (see FIG. 3). Arms 15 extend spirally between a base ring 13 and a hub 14 located facing away from base ring 13, these arms being connected to base ring 13 and hub 14. Arms 15 are here arcuate, wherein the convex sides are directed in the rotation direction R. Base ring 13, hub 14 and arms 15 are manufactured substantially from steel. This not only makes cutter head 10 strong but also gives cutter head 10 a great weight, whereby during dredging the cutter head 10 is urged in the direction of the ground for dredging under the influence of the gravitational force. Arms 15 are herein placed regularly around the periphery of cutter head 10. Passage openings 16 are located between arms 15. Coupling means 17 manufactured substantially from steel are welded to a leading edge 15*a* of arms 15 relative to the rotation direction of cutter head 10 for the purpose of coupling a first series of cutting tools (not shown) to arms 15. Coupling means 18 manufactured substantially from steel are likewise welded to the edge 15*b* of arms 15 facing away from the central axis of cutter head 10 for the purpose of coupling a second series of cutting tools (not shown) to arms 15. Coupling means 17,18 are oriented such that the front side or striking side of the cutting tools of the first and second series of cutting tools are directed in rotation direction R. Seven coupling means 17 are placed mutually equidistantly on leading edge 15*a* of arms 15, and six coupling means 18 are located mutually equidistantly on edge 15*b* of arms 15 facing away from the central axis of cutter head 10. The portions of leading edge 15*a* and the edge 15*b* facing away from the central axis of cutter head 10 close to hub 14 are both left clear of coupling means 17, 18. The portion of the edge 15*b* facing away from the central axis of the cutter head close to base ring 13 is likewise left clear of coupling means 18. Plough-like guides 18*a* are also formed integrally with coupling means 18 on their leading side, i.e. the side directed toward rotation direction R. When the cutter head 10 rotating in rotation direction R is brought into contact with the ground, loose ground parts will be forced rearward in the direction of openings 16 by plough-like guides 18*a*, whereby suction pipe 4 can easily discharge the ground parts urged through openings 16.

Figure 3:
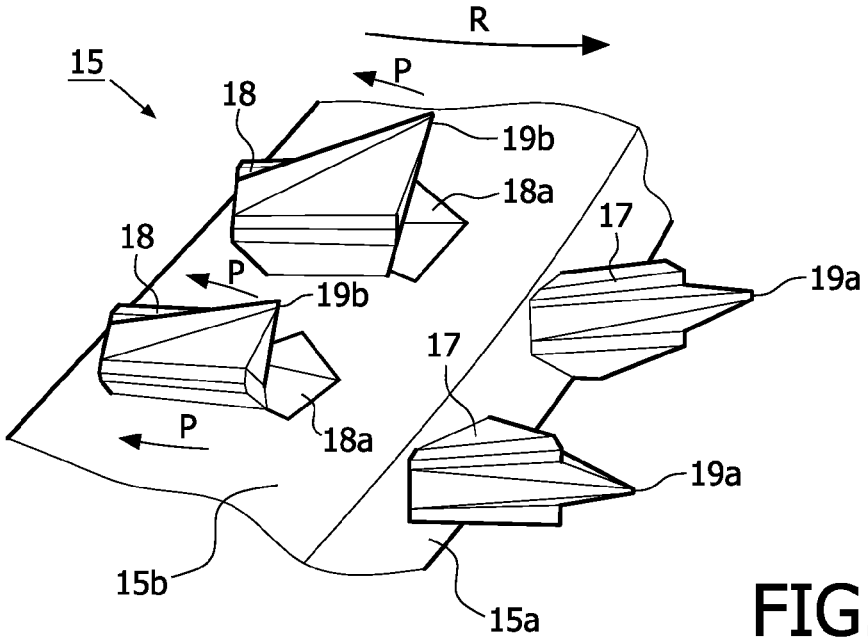
FIG. 3 shows a detail view of the cutter head of FIG. 2.

FIG. 3 shows by way of elucidation a detail view of an arm 15 of FIG. 2. Coupling means 17 for connecting a first series of cutting tools (not shown) to arm 15 on leading edge 15*a* are here offset relative to coupling means 18 for connecting a second series of cutting tools (not shown) to arm 15 on edge 15*b* facing away from the central axis of cutter head 10. FIG. 3 also shows the plough-like guides 18*a*. When arm 15 is rotated in rotation direction R, possible loose ground parts will be forced to the rear of arm 15 and openings 16 (see FIG. 2) as according to arrows P. This figure also shows cutting tools 19*a* of the first series of cutting tools coupled to coupling means 17, and cutting tools 19*b* of the second series of cutting tools coupled to coupling means 18. Cutting tools 19*a* of the first series are here offset relative to cutting tools 19*b* of the second series.

The invention claimed is:

1. A cutter head for dredging ground under water, the cutter head comprising:

a revolving body rotatable around a central axis and formed by a base ring and a hub which is placed at a distance therefrom and concentrically thereto and between which extend a number of arms, which arms are provided with cutting tools and between which are situated passage openings along which the dredged ground can be discharged, wherein the arms comprise a first series of cutting tools on a leading part as seen in the direction of rotation of the cutter head, and wherein at least one arm comprises a second series of cutting tools on a part facing away from the central axis.

2. The cutter head as claimed in claim 1, wherein the arms comprise edges, and that a leading edge, as seen in the direction of rotation of the cutter head, is provided with the first series of cutting tools, and wherein at least one arm is provided with the second series of cutting tools on an edge of the arm facing away from the central axis.

3. The cutter head as claimed in claim 1 or 2, wherein the cutter head comprises at least six arms, wherein passage openings are located between the arms.

4. The cutter head as claimed in claim 3, wherein the cutter head comprises at least eight arms.

5. The cutter head as claimed in claim 1, wherein at least one arm comprises at least eight cutting tools.

6. The cutter head as claimed in claim 5, wherein at least one arm comprises at least twelve cutting tools.

7. The cutter head as claimed in claim 6, wherein at least one arm comprises at least sixteen cutting tools.

8. The cutter head as claimed in claim 1, wherein on the same arm the cutting tools of a first series are disposed offset relative to the cutting tools of a second series.

9. The cutter head as claimed in claim 1, wherein the arms have a length and that the cutting tools are located on either side of the middle of the arms along a maximum of 80% of the length of the arm.

10. The cutter head as claimed in claim 9, wherein the cutting tools are located along a maximum of 80% of the length of the arm, as measured from the base ring.

11. The cutter head as claimed in claim 9, wherein the cutter head does not comprise cutting tools of the first and/or the second series along at most 20% of the length of the arms, as measured from the hub.

12. The cutter head as claimed in claim 1 wherein the cutting tools are connected to the arms via coupling means.

13. The cutter head as claimed in claim 12, wherein the arms of the cutter head are provided with guides on which the coupling means and/or the cutting tools are displaceably mounted.

14. The cutter head as claimed in claim 1, wherein the arms comprise plough-like guides for urging ground parts in the direction of the openings between the arms.

15. A method for dredging ground under water, wherein a cutter head as claimed in claim 1 is attached to a ladder of a cutter section dredger and moved over the ground by a lateral sweeping movement of the ladder, wherein the cutter head cuts into a ground with an Unconfined Compressive Strength (UCS) of between 50-200 MPa.

16. A cutter suction dredger provided with a cutter head as claimed in claim 1.

17. The method as claimed in claim 15, wherein the ground has an Unconfined Compressive Strength (UCS) of between 60-150 MPa.

18. The method as claimed in claim 17, wherein the ground has an Unconfined Compressive Strength (UCS) of between 80-100 MPa.

* * * * *